US007491875B2

(12) United States Patent
Cross

(10) Patent No.: US 7,491,875 B2
(45) Date of Patent: Feb. 17, 2009

(54) FRET DRESSING MASK

(76) Inventor: John Ames Cross, 7955 Haskell Ave. #4, Van Nuys, CA (US) 91406

( * ) Notice: Subject to any disclaimer, the term of this patent is extended or adjusted under 35 U.S.C. 154(b) by 0 days.

(21) Appl. No.: 11/743,898

(22) Filed: May 3, 2007

(65) Prior Publication Data

US 2008/0271587 A1 Nov. 6, 2008

(51) Int. Cl.
*G10D 1/08* (2006.01)

(52) U.S. Cl. ..... 84/314 R

(58) Field of Classification Search ..... 84/453, 84/314 R

See application file for complete search history.

(56) References Cited

U.S. PATENT DOCUMENTS 4,037,510 A * 7/1977 Ginex et al. ..... 84/453

* cited by examiner

*Primary Examiner*—Kimberly R Lockett
(74) *Attorney, Agent, or Firm*—Aaron P. McGushion

(57) ABSTRACT

The problem caused by the time consuming and potentially damaging process of applying a standard masking to the neck of a stringed instrument is solved by providing a strip of polymer material having slots formed therethrough and being complementarily configured to receive the frets while covering at least a portion of the neck to prevent damage to the neck in the fret filing process. Optionally, a non-permanent adhesive is provided on one side of the strip. This invention provides a fast means and method for applying a masking to a stringed instrument neck, that does not require a high level of expertise, while fully protecting the neck during the fret filing process.

13 Claims, 2 Drawing Sheets

FRET DRESSING MASK

BACKGROUND OF THE INVENTION

1. Field of the Invention

The present invention relates to the field of stringed instrument manufacturing, and more particularly, to the filing of frets on stringed instruments.

2. Description of the Related Art

Fretted stringed instrument manufacturing has evolved through the centuries from a hand made process, where the craftsman fabricated the instrument one at a time from beginning to end. It was a hand operation and the filing of the frets was an integral part of the hand fabrication. As used in this specification and the appended claims, the term "fret" means narrow metal bars embedded along the neck of stringed instruments. A fretted stringed instrument could include instruments such as guitars, banjos, and kimbundus, as well as other stringed instruments which also utilize a fretted neck.

The American guitar and instrument manufacturing industry still is inhabited by hundreds of small shops, but the demand for new models and specialty guitars has far outpaced the small manufacturer's ability to satisfy buyers needs. Larger manufacturing companies have come to dominate the market and produce large quantities of instruments on assembly line facilities, incorporating automated wood working machinery, metal fabrication, plating facilities and production painting with waterfall operations. However, luthiers (the people who makes or repairs stringed instruments) are still required to do the hand filing and leveling of the frets after they have been inserted into the wood neck.

Fret filing is a process where metal frets are filed after being installed into the neck of the instrument. The intent of this process is to precisely level all frets in relation to the adjoining frets. Visualize the process as a road grader on a gravel road, which is a long vehicle with a leveling tool in the middle. Filing is done with strokes running the length of the neck, while the file itself is held across the frets, parallel to the neck. In this manner, the high spots and the low spots of the multiple frets are smoothed out to a perfectly level plane, relative to one another. This is necessary so the instrument will play most efficiently and stay in good harmonic tune. When the musician fingers a string on different frets, by pressing the string against the fret, it produces desired notes.

The fret filing is one of the responsibilities of the Luthier, even on a large scale production line. Being hand operation, it is time consuming; however a large portion of that time is used masking the wood or other material of the neck between each of the frets. This operation alone takes twenty to thirty minutes as it requires several layers of masking tape or heavy paper.

Unlike masking for the spray painting process, fret masking requires protection from the damage which can be caused by the tools used in the filing process abrading against the wood or other neck material, causing scoring and other damage. At this point in the manufacturing process, a great deal of labor and high quality materials has been invested in the neck. Damage while filing would result in an unusable neck, thus a disruption to the production process and loss of money.

Prior to filing of the frets, the prior masking processes have always been a time consuming affair. It has required hand masking of the wood neck between each of the frets with several layers of masking tape. Protection of the wood during the filing process is paramount to quality neck fabrication. The existing process involves layering of masking tape with precision positioning of a strip of tape against each fret, on each side. That alone amounts to forty or more different applications of tape layered between the frets, so the wood is covered to protect from the filing process. This process of hand taping has been used for years, but is a high inefficient and time consuming process.

In attempts to shorten the masking process, a thin metal covering was formed to fit the guitar neck and then slots were filed in register with the frets. Though, in theory, this sounded like a solution, it failed as it was extremely hard to achieve register with frets to obtain the required close fit. Further, the metal edges were sharp and would cut and scratch the wood neck during the filing operation and would cut the Luthier's fingers.

Accordingly, there has been a long-felt need in the art for a device and method to protect the neck of a stringed instrument during the fret filing process. This device should be easy to use, taking a minimal amount of time to implement during the manufacturing process. The device should be easy to remove after the fret filing process. This device should also effectively protect every portion of the front face of the neck and the sides of the frets themselves, and optionally the sides of the neck.

OBJECTS OF THE INVENTION

It is an object of the present invention to provide an improved masking device for protecting the neck of the instrument during the fret filing process;

It is a further object of the present invention to provide an improved masking device that can be quickly attached to the neck while providing the necessary coverage; and It is a further object of the present invention to provide an improved masking device that can be easily removed following the fret filing process.

These and other advantages and attainments of the present invention will become apparent to those skilled in the art upon a reading of the following detailed description when taken in conjunction with the drawings wherein there is shown and described an illustrative embodiment of the invention.

SUMMARY OF THE INVENTION

The present invention is directed to a novel masking for use in the fret filing process to protect the neck of a stringed instrument from scaring and other damage from the abrasion of the file, while permitting necessary filing access to the frets installed on the neck. The present invention permits a quick to install and consistent masking that can be used with little skill, allowing the worker to focus on the filing process. The present invention is also easy to remove, requiring relatively little time and effort, and leaving no residue on or damage to the neck.

The problem caused by the time consuming and potentially damaging process of applying a standard masking to the neck of a stringed instrument is solved by providing a strip of polymer material having slots formed therethrough and being complementarily configured to receive the frets while covering at least a portion of the neck to prevent damage to the neck in the fret filing process. In a preferred embodiment of the present invention a masking is provided for use with a stringed instrument having a plurality of frets spaced along a top face of a neck comprising a strip of polymer material having a plurality of slots formed through the material, the slots being sized and positioned complementarily to the frets, the slots are configured to receive the frets when the strip is attached to the neck during manufacture, the frets being substantially exposed and the top face being substantially covered, where the masking substantially protects the neck from damage during a fret filing process.

It is important to note that the material for the masking is preferably pliable and non-damaging to the neck and to the frets, such as vinyl or the like. Additionally, the slots are preferably cut so that there is substantially little or no clearance between the masking and frets, completely covering the front face of the neck, while leaving the frets exposed and ready to receive the file for filing. The slots can also be configured to match the varying length of the frets. The masking is can be attached to the neck by many means, such as temporary adhesives, hook and loop fasteners, straps, or other appropriate fastening means. The masking is preferably designed to be temporarily attached to the neck, being removed at some point after the filing process.

Optionally, the width of the strip may be wider than the width of the neck, providing an overhang on at least one side of the neck. In this embodiment, the preferred option is to provide an overhang for each side of the neck, so that the overhang can be wrapped about both sides of the neck to protect it more thoroughly from damage. Additional overhangs are also possible, if the desire is to protect neighboring areas of the instrument.

The thickness of the masking is preferably thick enough to provide adequate protection from abrasion during the filing process. However, the thickness should not be so great as to interfere with the filing process. If the strip is too thick, the masking could prevent the worker from properly leveling the frets, due to interference. The thickness is not restricted to, but preferably ranges between 4 mm and 8 mm, for many applications. Again, thicker or thinner materials are possible, if they meet the requirements of protecting the neck while not interfering with the filing process.

In yet another preferred embodiment of the present invention a for filing a plurality of frets installed along a neck of a stringed instrument, comprising the steps of attaching a polymer masking to the neck, the polymer masking having a plurality of slots complementarily configured to receive the plurality of frets, the frets being exposed and a top face of the neck being covered; filing the exposed frets; and removing the polymer masking after filing. And additional step could include wrapping an overhanging portion of the polymer masking at least partially around the neck before filing.

Figure 1:
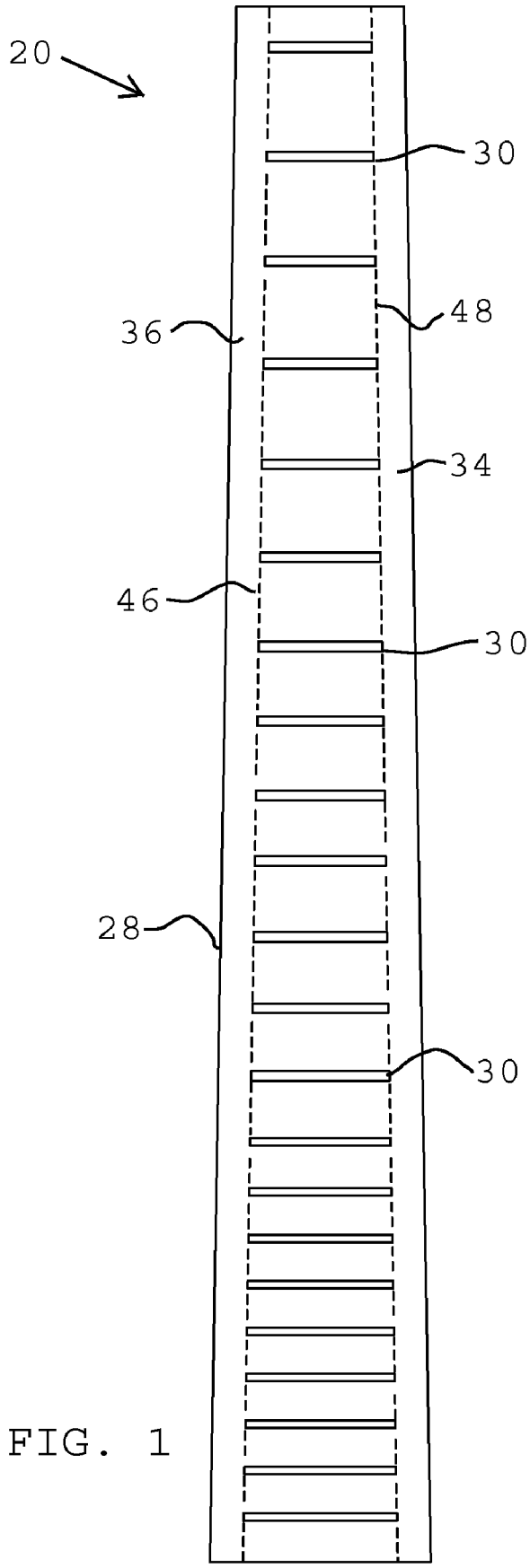
FIG. 1 is a plan view of the preferred embodiment of the present invention, showing the masking with the slots formed through it.

LISTING OF REFERENCE NUMERALS OF FIRST-PREFERRED EMBODIMENT masking 20
neck 22
fret 24
top face 26
strip of polymer material 28
slot 30
adhesive side 32
overhang 34, 36
arrow 38
arrow 40
fret filing tool 42
side 44
phantom line 46, 48
first fret 50

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

A plan view of the masking 20 of the present invention can be seen in FIG. 1. The masking 20 is preferably made of a thin strip of polymer material 28 with a plurality of slots 30 cut through the material. These slots 30 can be made by many known processes, such as cutting, punching or other appropriate means. While only several of the slots 30 are indicated directly with a reference number, it can be seen that there are quite a few more along the strip 28, usually numbering between twenty and twenty four slots 30. It can also be seen that the slots 30 may vary in width and spacing, one to the other, being designed to substantially match the fret 24 pattern on the neck 22.

In an optional embodiment, the masking 20 is configured to be wider than the instrument neck 22 (shown in FIGS. 2A-C), creating an overhang 34 and 36. The phantom lines 46 and 48 indicated the region of overhang, that extends beyond the width of the neck 22. Additionally, the overall length of the masking 20 can be longer than the neck 22, to provide additional protection.

The overall shape of the masking 20 is not important, although a trapezoidal or rectangular shape may be preferred. Whatever the over shape is, it must provide the minimum coverage that is needed in the fret filing process.

Figure 2A:
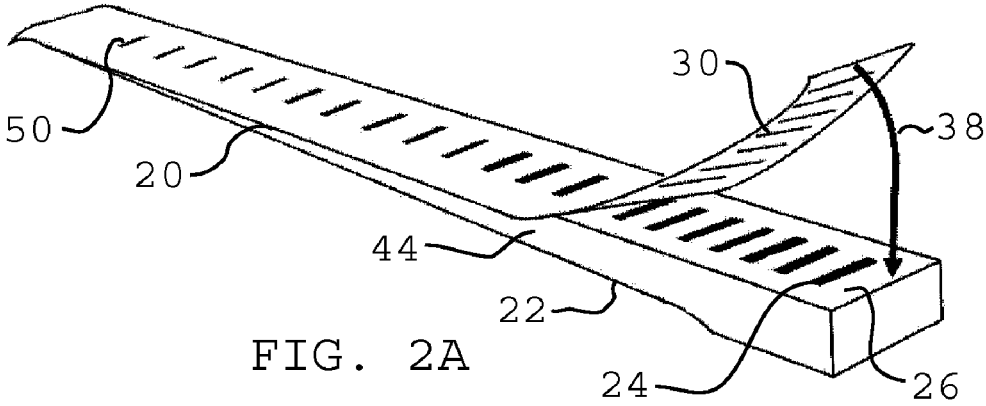
FIGS. 2A-C are perspective views of the preferred embodiment of the present invention, showing the masking during the attachment, filing, and removal processes.
Figure 2B:
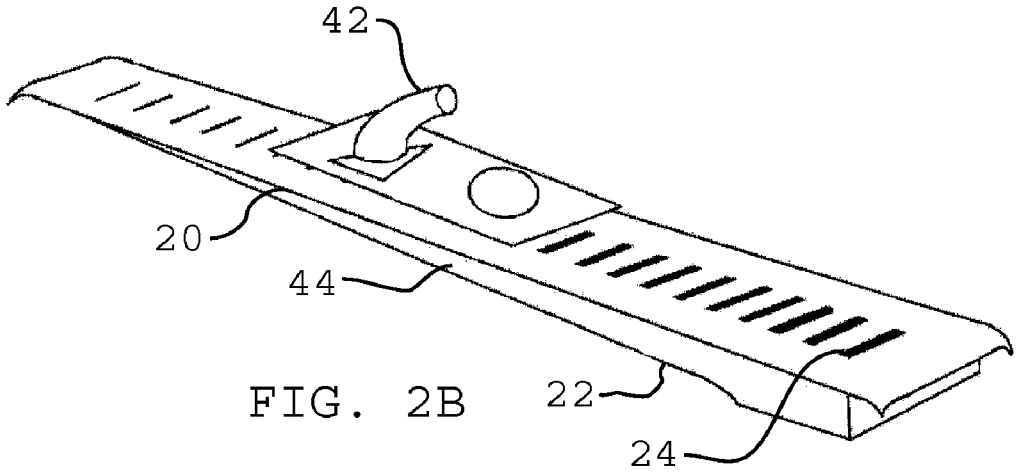
Figure 2C:
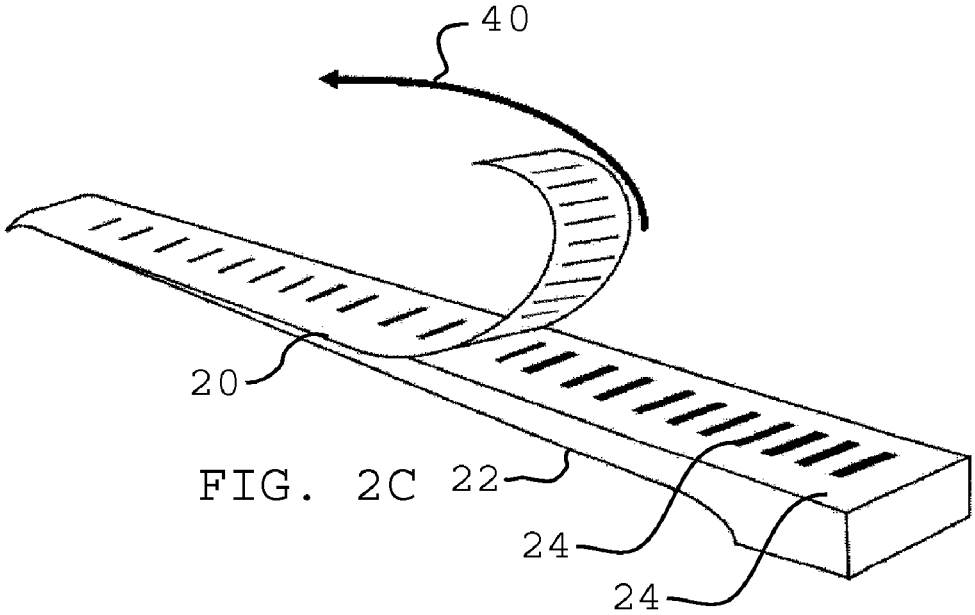

Looking now at FIGS. 2A-C, a method of using the masking 20 of the present invention can be seen more clearly. Looking first at FIG. 2A, the masking 20 is being applied to the neck 22, as indicated by arrow 38; the adhesive side 32 being adhered to the top face 26 of the neck 22. After first removing the adhesive side 32 paper backing (not shown), the first fret 50 is positioned in the respective slot 30; then the other frets 24 fall into place, using finger pressure to stick the masking 20 down to the top face 26. The stringed instrument is not shown, as it is often attached to the neck 22 at a later stage, using means well known in industry; although the masking 20 can be used on a neck 22 that is attached to an instrument as well. It can also be seen that the slots 30 align with the frets 24, for easy application and a tight fit, preferably covering the entire top face 26.

FIG. 2B shows the fret filing process in action. The fret filing tool 42 is applied to the frets 24, and the worker begins the standard filing process. The only parts of the neck 22 that is exposed to the tool 42 work area, are the frets 24. For additional protection, the overhangs 34 and 36 can be wrapped around the neck to varying extents to provide protection to other parts of the neck 22, if needed.

The removal of the masking 20 is shown in FIG. 2C, with the arrow 40 indicating one method of removal possible, by pulling with a shearing action to break the adhesive bond between the masking 20 and the top face 26. Preferably, the adhesive is of the removable or temporary type, although other attachment or adhering means are possible. The masking 20 can also be left on the neck 22 for extended times, such as for providing further protection with other processes, such as a further finishing process.

The slots 30 are cut into the vinyl material of the masking 20 during fabrication, which allows the frets 30 to protrude through the masking 20 when it is applied to the neck 22. The overall dimensions of the masking 20 could remain the same for all instruments, but fret 24 numbers, sizes, and spacing vary from one instrument model to the next. Because an exact fit is necessary for accurate tooling, the slots 30 must be tailored to the specific model of guitar or instrument.

In one optional embodiment, the masking 20, is fabricated from an adhesive backed four millimeter thick vinyl sheet and is cut on a computer controlled machine specifically designed for cutting sheet vinyl. This vinyl was developed and is produced for use as backing of graphics and signs. As stated above, the overall dimension of the masking may remain the same, and the tailoring of slot 30 dimensions and positioning is accomplished within the computer program for the specific instrument run. The application of computer cutting creates a highly customizable product that can be applied to numerous necks of various instruments, providing precision fit and compensating for various fret spacing, size, and number.

By initially designing the maskings 20 in an existing computer graphics software means, the ability to cut the masking 20 from existing equipment designed for graphics production is achieved. Then, as orders are received for a specific instrument, the basic dimensions are adjusted within the software to the measurements and spacing of the frets 24 on each instrument model. With that flexibility, the basic masking 20 can be economically produced to fit specifications as necessary. A white vinyl is used for the masking 20, though it is not a factor, as they can be produced in any color.

In the manufacturing of guitars and similar fretted stringed instruments, the neck 22 assembly is completed before attachment to the body of the instrument. This process includes hand filing frets 30 to a level plane. To accomplish this without damaging the wood or other material of the neck 22, the masking 20 is placed on the completed neck 22, thus covering and protecting the wood, yet leaving the frets 30 exposed for tooling. With the masking 20 in place, the guitar craftsman, (known in the industry as a luthier) can then file the frets 30 without scaring the expensive wood, usually rose or ebony. Installation of the masking 20 takes less than two minutes and removal takes about one minute. Application and removal time is about ten percent of the existing method. As production of instruments can run in to the thousands, the labor savings is considerable.

The masking 20 product will be provided to the final user as a precut vinyl mask, other polymer materials also being acceptable, with a non-permanent adhesive backing, which is applied to the neck 22 of the instrument prior to fret 24 filing. This vinyl masking 20 has slots 30 which are in register with the frets 24 and when applied to the neck 22, leaving the frets 24 exposed for the filing process. Precut maskings 20 are configured to fit closely to protect the guitar neck 22 during the filing process.

While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. A masking for use with a stringed instrument having a plurality of frets spaced along a top face of a neck, comprising:

a strip of polymer material having a plurality of slots formed therethrough, said slots being sized and positioned complementarily to said frets;

said slots configured to receive said frets when said strip is attached to said neck during manufacture, said frets being substantially exposed and said top face being substantially covered;

whereby said masking substantially protects said neck from damage during a fret filing process.

2. The masking of claim 1 wherein the width of said strip is wider than the width of said neck, providing an overhang on at least one side of said neck.

3. The masking of claim 2 wherein said overhang is configured to be wrapped at least partially around said side of neck, thereby protecting said side from damage.

4. The masking of claim 1 wherein the thickness of said polymer material is sufficiently thick to prevent damage to said neck.

5. The masking of claim 2 wherein the thickness of said polymer material is sufficiently thin to prevent interference with said fret filing process.

6. The masking of claim 2 wherein said masking is configured to be temporarily attached to said neck in preparation for said fret filing process, being removed afterwards.

7. The masking of claim 6 wherein one side of said masking is coated with an adhesive to permit the temporary attachment to at least said front face.

8. The masking of claim 2 wherein said slots vary in length one to the other, corresponding to a varying in length of said frets along said neck.

9. The masking of claim 2 wherein the sizes of said slots are configured to permit the insertion of said frets with substantially no clearance, whereby no portion of said front face is exposed during said fret filing process.

10. The masking of claim 2 wherein said polymer material is vinyl.

11. The masking of claim 10 wherein the thickness of said vinyl is a minimum 4 mm and a maximum of 8 mm.

12. A method for filing a plurality of frets installed along a neck of a stringed instrument, comprising the steps of:

providing a polymer masking having a plurality of slots complementarily configured to receive said plurality of frets;

attaching said polymer masking to said neck, said frets being exposed and a top face of said neck being covered;

filing said exposed frets; and removing said polymer masking after filing.

13. The method of claim 12 further comprising the step of:

wrapping an overhanging portion of said polymer masking at least partially around said neck before filing.

* * * * *